United States Patent [19]

Matsumae et al.

[11] Patent Number: 4,485,569

[45] Date of Patent: Dec. 4, 1984

[54] SPUD ARRANGEMENT FOR A DREDGE

[75] Inventors: Hiroshi Matsumae; Hisayoshi Myojin; Sumitada Morishita, all of Hiroshima, Japan

[73] Assignee: Mitsubishi Jukogyo Kabushiki Kaisha, Japan

[21] Appl. No.: 492,335

[22] Filed: May 6, 1983

[51] Int. Cl.[3] ..... E02F 3/88

[52] U.S. Cl. ..... 37/73; 114/230

[58] Field of Search ..... 37/73, 74; 114/293, 114/294, 230; 440/36; 405/224, 227

[56] References Cited

U.S. PATENT DOCUMENTS

| | | | |
|---|---|---|---|
| 428,141 | 5/1890 | Robinson | 37/73 |
| 521,580 | 6/1894 | Bates | 37/67 |
| 1,307,574 | 6/1919 | Bager | 37/74 |
| 3,272,477 | 9/1966 | Schmidt | 37/73 X |
| 3,572,408 | 3/1971 | Hnot | 114/230 X |
| 3,777,919 | 12/1973 | Konijn | 37/73 X |
| 3,987,563 | 10/1976 | Baur | 37/73 |
| 4,033,056 | 7/1977 | Demmers | 37/73 |
| 4,202,119 | 5/1980 | Grace | 37/73 X |
| 4,445,290 | 5/1984 | Oules | 37/66 |

FOREIGN PATENT DOCUMENTS

| | | | |
|---|---|---|---|
| 26380 | 4/1932 | Netherlands | 37/73 |
| 175001 | 11/1965 | U.S.S.R. | 37/73 |

OTHER PUBLICATIONS

"Engineering News", p. 545, Mar. 12, 1914.

*Primary Examiner*—Clifford D. Crowder
*Attorney, Agent, or Firm*—McGlew and Tuttle

[57] ABSTRACT

An improved working vessel such as a dredger or the like of the type including a working apparatus at one end of the vessel body and a spud serving as a turning shaft member for the vessel body at the other end, includes the improvement wherein the turning staff member comprises an arm shaft extending toward the bottom of the sea from the vessel body at a downward inclination angle and a lowermost end member adapted to penetrate the bottom of the sea. The arm shaft is pivotally connected to the vessel body by way of a horizontally extending shaft at the upper end thereof and is hung up from a gantry fixedly mounted on the vessel body with the aid of a wire extending downwardly from the gantry.

8 Claims, 19 Drawing Figures

SPUD ARRANGEMENT FOR A DREDGE

BACKGROUND OF THE INVENTION

1. Field of the Invention

The present invention relates to an improved working vessel such as a dredger or the like and more particularly to a working vessel of the type including a working apparatus at the one end part of the vessel body and a turning shaft member for the vessel body at the other end part of the body.

2. Description of the prior art

Hitherto known pump suction type dredgers are typically illustrated in FIGS. 1 to 4.

One of the conventional dredgers will be described first with reference to FIGS. 1 and 2. As will be apparent from the drawings, a main spud 1 and an auxiliary spud 2 are arranged at the one end part of the vessel body, whereas working means comprising a ladder 6 and swing wires 7 is arranged at the other end part of the vessel body so as to carry out a dredging operation. However, this spud type dredger has a drawback in that trouble often takes place in the form of breakage of the spuds 1 and/or 2 due to bending moment arising from surging of the vessel body under the influence of rushing waves. It is known from hitherto encountered experience that an operational limit is defined by a wave height in the range of 0.4 to 0.5 m in a sea area where a so-called swell having an average period longer than 7 seconds is developed. When a dredging operation is to be carried out under more critical climate condition, a Christmas tree type dredger as illustrated in FIGS. 3 and 4 is employed. In the Christmas tree type the dredger includes an anchoring mechanism 3 and wires 4 at the one end part of the vessel body so as to maintain the dredger at a predetermined position and the dredging operation is carried out while the vessel body is caused to turn to the left and right about the Christmas tree type anchoring mechanism 3 as a center of turning movement with the aid of swing wires 7 adapted to be reeled or unreeled, said swing wires 7 extending from the fore part of the ladder 6 in both the leftward and rightward directions. It is found that the Christmas tree type dredger can be operated more satisfactorily than the spud type one under any critical climate condition on the sea but the former has drawbacks that the vessel body is maintained with a predetermined position at less accuracy than that of the latter and therefore a precise dredging operation fails to be carried out.

One of factors causing reduced efficiency and an operational limit of the dredging operation with the conventional pump suction type dredgers under the influence of rushing waves is attributable to the fact that a cutter head at the foremost end of the ladder is largely displaced in both the vertical and longitudinal directions due to displacement of the vessel body under the influence of rushing or roaring waves, resulting in reduced capacity of suction and occurance of damage or injury on the dredging apparatus including cutter, cutter shaft and others.

It is believed that a cause for degraded properties of the conventional pump suction type dredger consists mainly in reduced strength of the anchoring mechanism, low resistibility against high waves and a large extent of displacement of the cutter head in both the vertical and longitudinal directions. To resolve the foregoing problems there was proposed an improved system in which the vessel body is held on the water surface with the aid of a jack-up apparatus. However, the proposed system has drawbacks that a dredger is manufactured at a very expensive cost and operation of the dredger is largely dependent on geometrical conditions at the bottom of the sea.

SUMMARY OF THE INVENTION

Thus, the present invention has been made with the foregoing drawbacks which are inherent to the conventional dredgers, in mind.

It is an object of the present invention to provide an improved working vessel such as a dredger or the like which can be manufactured at substantially the same cost as that of the conventional ones.

Another object of the present invention is to provide an improved working vessel such as a dredger or the like which is simple in structure.

It is another object of the present invention to provide an improved working vessel such as a dredger or the like which assures an improved anchoring property and resistibility against displacement of the vessel body and the cutter head.

It is still another object of the present invention to provide an improved working vessel such as a dredger or the like which assures increased stability of the vessel body against rushing waves.

As a result of repeated operations on the sea it has been confirmed that the present invention can be satisfactorily applied to pump suction type dredger, bucket wheel type dredger, dumped stone leveler or the like vessel.

Now, characterizing features of the present invention will be noted below.

(1) The conventional vertical type spud is replaced with a new inclined type spud extending from the vessel body toward the bottom of the sea at a downward inclination angle, said inclined type spud comprising an arm shaft and a pivotal lowermost end member.

(2) The arm shaft is pivotally connected to the vessel body by way of a horizontally extending shaft while it is hung up from a gantry fixedly mounted on the vessel body with the aid of a wire which is normally tensioned during an intended work so as to inhibit displacement of the vessel body as well as angular displacement of the arm shaft.

(3) An additional arrangement of a new vessel body displacement mechanism to be described later assures substantially reduced manufacturing cost and improved operational reliability, compared with the conventional spud-carriage system.

It should be noted that a combination of the above-mentioned characterizing features (1) and (2) assures reduction of bending moment exerted on the spud under the influence of rushing waves, remarkable inhibition of pitching and surging of the vessel body and reduction of displacement of the cutter head in both the vertical and longitudinal directions.

Thus, to accomplish the above objects there is proposed in accordance with the present invention an improved working vessel of the type including a working apparatus such as dredging means or the like at the one end part of the vessel body and a turning shaft member such as spud or the like at the other end part of the same, wherein said turning shaft member comprises an arm shaft extending from the vessel body toward the bottom of the sea at a downward inclination angle and a lowermost end member adapted to be embedded in the bottom of the sea, said arm shaft being pivotally connected to the vessel body by way of a horizontally extending shaft at the upper end part thereof while it is hung from a gantry fixedly mounted on the vessel body with the aid of a wire extending downward from the gantry to the arm shaft, said wire being tensioned during the intended work.

According to the invention the arm shaft and/or the lowermost end member is fitted with an additional dead weight.

Also, according to the invention the working vessel includes a spud connecting arm of which one end is pivotally connected to the upper end part of the arm shaft by way of a horizontally extending shaft and of which other end is pivotally connected to the vessel body by way of another horizontally extending shaft, wherein a driving mechanism such as hydraulic cylinder or the like is fixedly mounted on the vessel body so as to swing the spud connecting arm back and forth in the longitudinal direction with the aid of an actuating rod or the like means thereof.

Further, according to the invention an arm shaft constituting the spud as a turning shaft member is pivotally connected directly to the vessel body by way of a horizontally extending shaft such as trunnion or the like means in an inclined posture.

Other objects, features and advantages of the invention will be more clearly apparent from reading of the following description made in conjunction with the accompanying drawings.

BRIEF DESCRIPTION OF THE DRAWINGS

The accompanying drawings will be briefly described below.

FIGS. 1 and 2 schematically illustrate an example of conventional working vessels, wherein FIG. 1 is a side view of the working vessel and FIG. 2 is a plan view of the same with a gantry removed therefrom.

FIGS. 3 and 4 schematically illustrate another example of conventional working vessels, wherein FIG. 3 is a side view of the working vessel and FIG. 4 is a plan view of the same with a gantry removed therefrom.

FIGS. 5 and 6 schematically illustrate a working vessel in accordance with the first embodiment of the present invention, wherein FIG. 5 is a plan view of the working vessel with a gantry removed therefrom and FIG. 6 is a plan view of the same.

FIGS. 7 and 8 schematically illustrate how the conventional working vessel is caused to move when waves collide against it in the transverse direction, wherein FIG. 7 is a front view of the working vessel as seen from behind the vertical spud and FIG. 8 is a diagram of bending moment exerted on the spud.

FIGS. 9 and 10 are illustrations similar to FIGS. 7 and 8 when waves collide against the working vessel in the longitudinal direction, wherein FIG. 9 is a side view of the working vessel and FIG. 10 is a diagram of bending moment exerted on the vertical spud.

FIGS. 11 and 12 schematically illustrate how the working vessel is displaced in the vertical direction when waves collide against the working vessel in the longitudinal direction, wherein FIG. 11 is a side view of the conventional working vessel and FIG. 12 is a side view of the working vessel of the invention.

FIGS. 13 to 15 are each a characteristic diagram comparatively illustrating functional properties of the conventional working vessel and the working vessel of the invention, wherein FIG. 13 illustrates a relation between period of waves and ratio of vertical displacement/wave height, FIG. 14 shows a relation between period of waves and ratio of longitudinal displacement/wave height and FIG. 15 shows a relation between period of waves and ratio of transverse displacement/wave height.

FIGS. 16 and 17 schematically illustrate a working vessel in accordance with the second embodiment of the present invention, wherein FIG. 16 is a partial side view of the working vessel and FIG. 17 is a partial plan view of the same, and FIGS. 18 and 19 schematically illustrate a working vessel in accordance with the third embodiment of the present invention, wherein

DETAILED DESCRIPTION OF THE PREFERRED EMBODIMENTS

Now, the present invention will be described in a greater detail hereunder with reference to the accompanying drawings which illustrate preferred embodiments of the invention.

Figure 1:
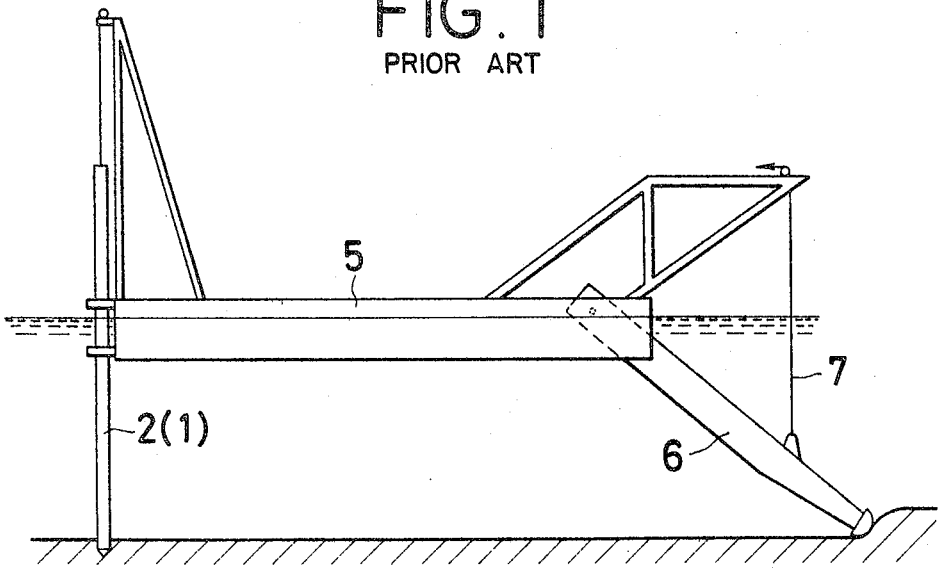
FIG. 1 PRIOR ART
Figure 2:
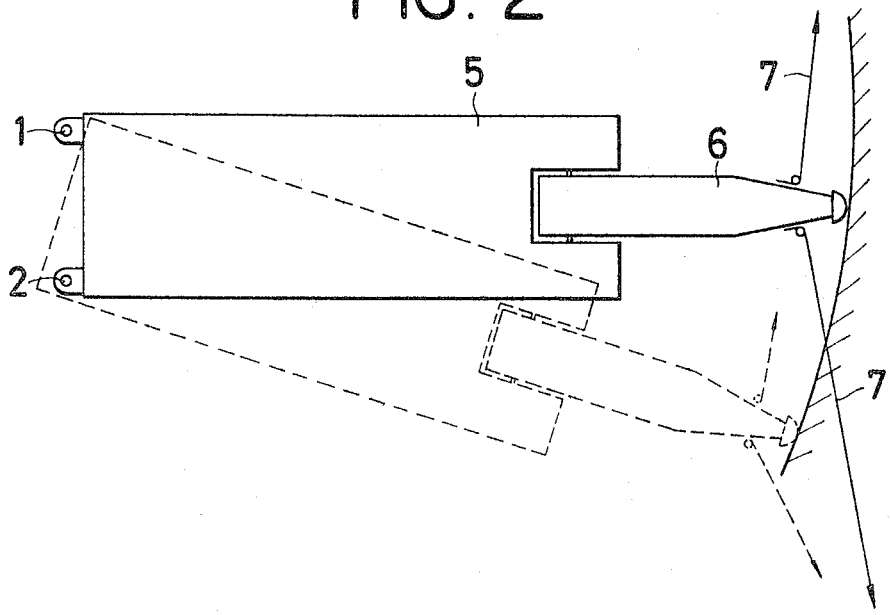
PRIOR ART FIG. 2
Figure 3:
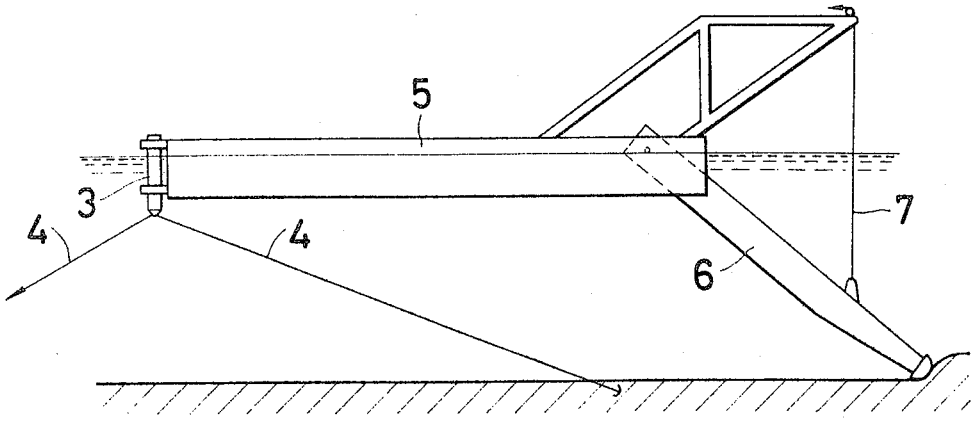
FIG. 3 PRIOR ART
Figure 4:
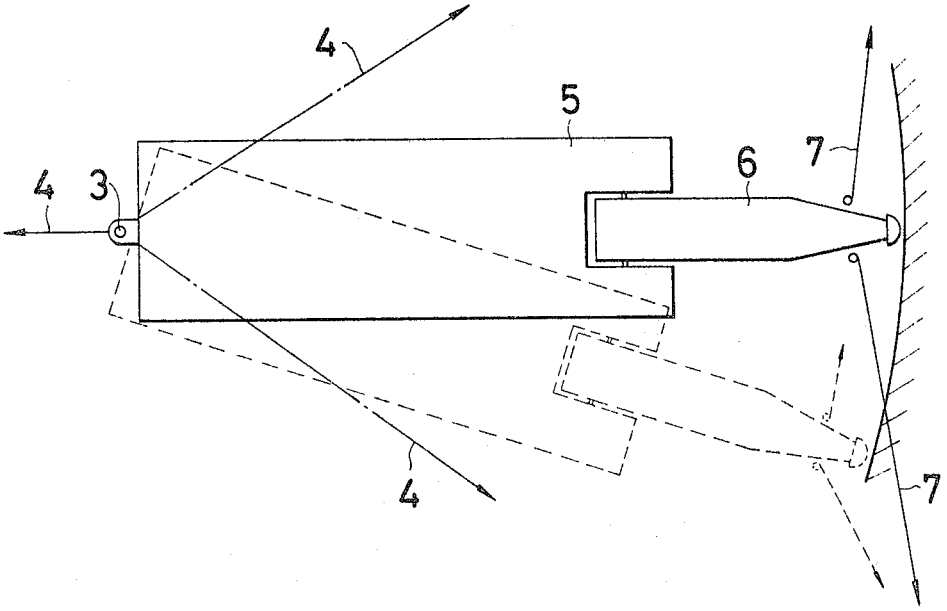
PRIOR ART FIG. 4
Figure 5:
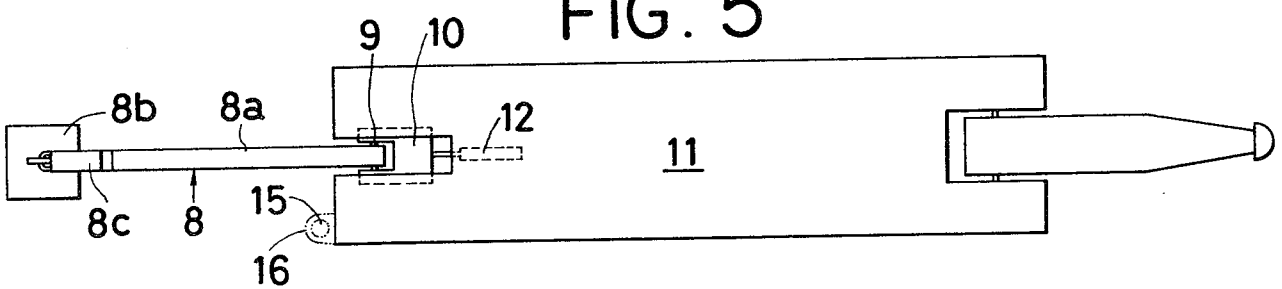
Figure 6:
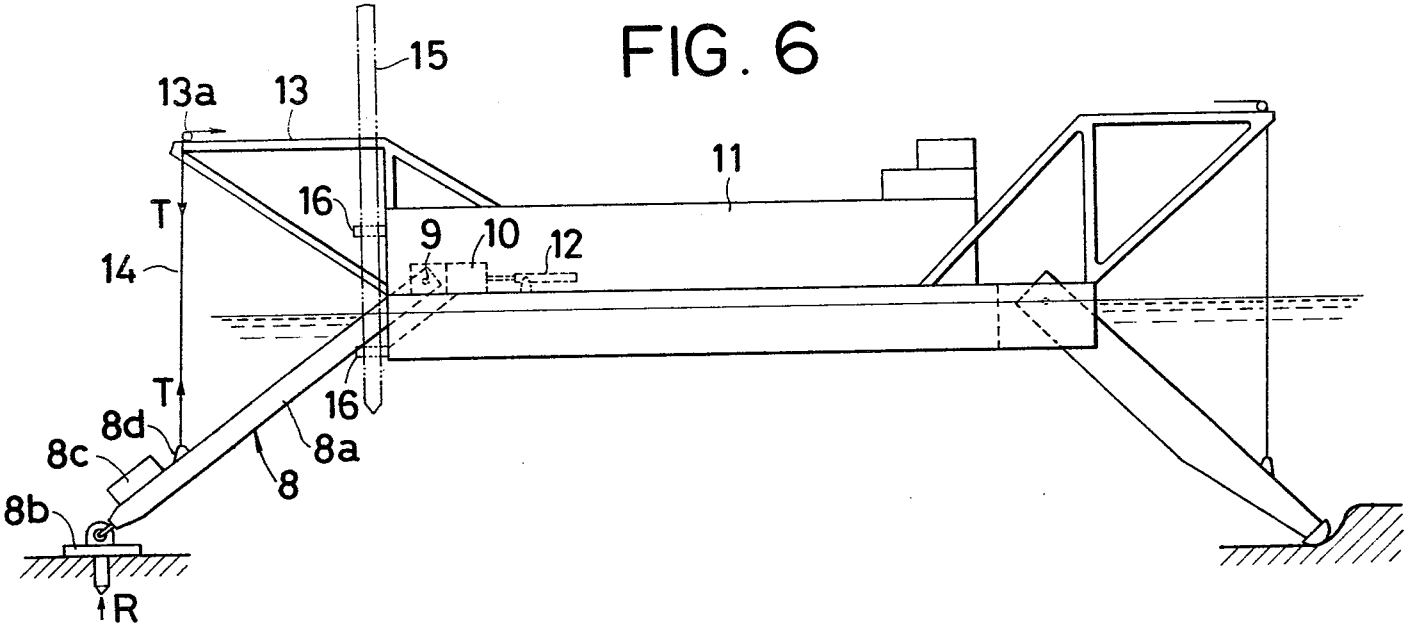

First, description will be made as to a working vessel in accordance with the first embodiment of the invention with reference to FIGS. 5 and 6.

In the drawings reference numeral 8 designates a spud serving as a turning shaft of which upper end part is fitted into a cavity at the one end part of a vessel body 11. Specifically, the spud 8 essentially comprises an arm shaft 8*a*, a penetrating portion 8*b* and an additional weight 8*c*, said arm shaft 8*a* including a hook 8*d* at which a wire 14 is anchored at the lowermost end thereof. The upper end of the wire 14 is engaged to a pulley 13*a* on a spud gantry 13 while it extends around said pulley 13*a*. The extreme end of the wire 14 is fixedly connected to a conventional wire tensioning means which is not shown in the drawing.

A spud carriage 10 is disposed on a deck of the vessel body 11 with rollers or sliding surface (not shown) interposed therebetween so that the upper end part of the spud 8 is pivotally connected to said spud carriage 10 by way of a trunnion 9. The spud carriage 10 is operatively connected to a hydraulic cylinder 12 fixedly mounted on the vessel body 11 so that it is displaced back and forth with the aid of said hydraulic cylinder 12. To firmly hold an auxiliary spud 15 in the vertical posture a pair of spud keepers 16 are provided on the end face of the vessel body 11 at both the upper and lower parts of the spud side thereof. The auxiliary spud 15 is in use when the spud 8 is replaced with the former. A variety of dead weights may be employed for the additional weight 8*c* and it is preferable that steel ingot having a weight in the range of 150 to 200 tons divided into 10 to 20 pieces is fixed onto the arm shaft 8*a* by means of bolts or the like.

Next, operations of the working vessel will be described below.

Before dredging operation is initiated, the wire 14 is previously tensioned with the aid of a conventional means. The embedded portion 8*b* at the lowermost end of the spud is subjected to a reaction force R active from the bottom of the sea during the dredging operation, and owing to the fact that the wire 14 is tensioned with the required tension T there occures no fluctuation in relative angle formed by the vessel body 11 and the arm shaft 8*a* of the spud as long as the reaction force R and the tension T are not zero, even when the vessel body 11 is exposed to outer force caused by a number of high waves. As a result the spud 8 is kept in a stable state as if it is fixed to the vessel body 11.

Dredging operation is carried out while the vessel body 11 is displaced forward step by step by a predetermined distance by actuating the hydraulic cylinder 12. After the hydraulic cylinder 12 is actuated by the full stroke, the auxiliary spud 15 is driven into the bottom of the sea while the spud 8 is lifted up with the embedded portion 8*b* removed from the bottom of the sea. On completion of replacement of the spud 8 with the auxiliary spud 15 by forward displacement of the spud carriage 10 with the aid of the hydraulic cylinder 12 of which actuating rod is retracted the vessel body 11 is caused to move forward by expanding the actuating rod of the hydraulic cylinder 12.

It should be noted that in order to prevent the auxiliary spud 15 from being damaged or broken due to a series of rushing high waves the spud keepers 16 should be preferably fitted with a shock absorber or the like means respectively. Owing to the arrangement of the shock absorber or the like means it becomes possible to handle the auxiliary spud 15 under the influence of roaring waves.

As will be readily apparent from the above description, the working vessel of the invention has advantageous features that the spud can be handled under the influence of rushing waves and the cutter head can be operated with substantial reduction in vibration or fluttering arising from rushing waves, resulting in improved operational limit as defined by the influence of waves.

Next, characterizing features of the invention will be described in more details below.

(i) First, description will be made as to strength of the spud under the influence of roaring waves.

Figure 7:
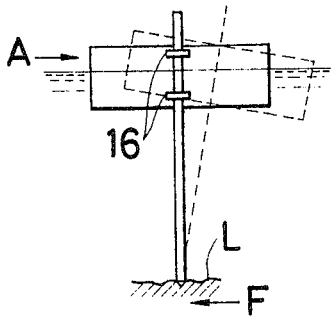
Figure 8:
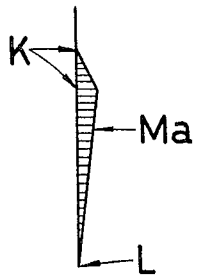

As is apparent from FIGS. 7 and 8, the vessel body 11 of the conventional dredger with a vertical spud employed therefor is caused to incline and move in the transverse direction easily when it is subjected to lateral force A arising from rushing waves, because the width of the vessel body is dimensioned substantially smaller than the length of the same. For the reason force exerted on the spud in the transverse direction is comparatively small and therefore bending moment Ma caused by said force is also small. In the drawing reference letter F designates a reaction force at the bottom of the sea, reference letter L does the bottom of the sea and reference letter K does the position where the spud is operatively engaged to the vessel body.

Figure 9:
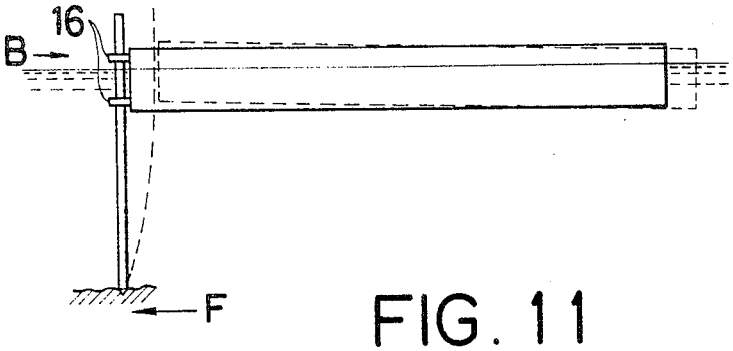
Figure 10:
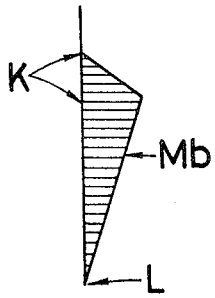

On the other hand, as is apparent from FIGS. 9 and 10, the vessel body is caused to incline at a small inclination angle and therefore move only by a short distance in the longitudinal direction when it is subjected to longitudinal force B arising from rushing waves, because the length of the vessel body is dimensioned substantially larger than the width of the same. For the reason force exerted on the spud in the longitudinal direction is large whereby high bending moment Mb appears across the cross-sectional area of the spud at the position in the proximity of the lower end part of the spud keeper 16 by means of which the spud is firmly supported. Further, it is often found that very high bending moment is caused, resulting in an occurance of breakage of the spud, when a characteristic period of surging of the vessel body coincides with a period of the waves.

Further, since high bending moment is exerted on the spud carriage due to the aforesaid longitudinal force and thereby the spud carriage and its associated members are affected by excessive force caused by said high bending moment, operation of the working vessel is inhibited during the influence of high waves.

On the contrary, since the inclined type spud of the invention is constructed so as to hold the vessel body 11 with the aid of the arm shaft 8*a* extending at a certain inclination angle and to anchor it in the longitudinal direction, it is assured that no coincidence takes place between a period of surging of the vessel body and a period of the waves. Thus, force exerted on the spud 8 can be reduced much more than in case of the conventional vertical spud type working vessel.

Further, since the spud 8 of the invention is operatively connected to the spud carriage 10 by means of a horizontally extending shaft in the trunnion 9, very small bending moment is caused on the arm shaft 8*a* and force exerted on the vessel body 11 in the longitudinal direction is borne mainly by the axial strength of the arm shaft 8*a*. As a result the working vessel can stand against a high intensity of longitudinal force satisfactorily. It should be noted that no moment is caused on the transversely extending shaft of the spud carriage 10. Further, since force exerted on the spud 8 in the transverse direction is comparatively small as is the case with the conventional vertical type spud, it becomes possible to handle the spud and the spud carriage even under the influence of roaring waves by employing the inclined type spud of the invention.

Figure 11:
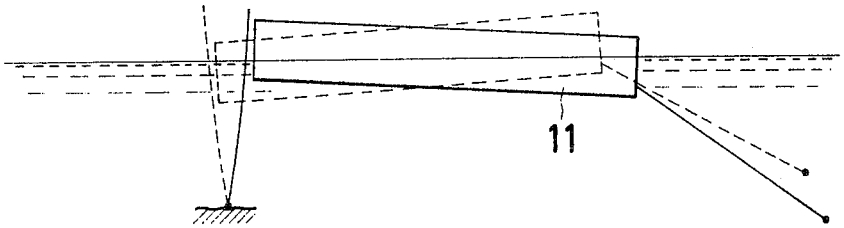

(ii) Next, description will be made as to functional effect on vibration or fluttering of the cutter head in the dredging apparatus during the influence of roaring waves with reference to FIGS. 11 and 12.

With respect to pitching of the vessel body which constitutes a main factor for causing vertical displacement or vibration of the cutter head under the influence of rushing waves it is found with the conventional vertical type spud that no restrictive force is developed on the vessel body in the vertical direction, because there is formed a clearance between the spud and the spud keeper. Thus, as roaring waves collide against the vessel body in the longitudinal direction or at a certain inclination angle relative to the longitudinal axis of the vessel body, a high magnitude or pitching takes place. Further, as will be apparent from FIG. 11, a high magnitude of displacement or vibration of the cutter head in the longitudinal direction takes place in addition to the aforesaid vertical displacement or vibration of the same because of a combination of pitching and surging of the vessel body when a period of pitching and surging coincides with a period of waves, resulting in reduced efficiency of dredging operation and the occurance of damage or injury on the dredging apparatus.

Figure 12:
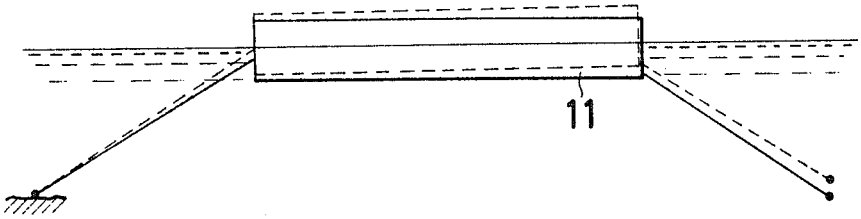

On the contrary, as will be apparent from FIG. 12, the vessel body 11 for which the spud structure of the invention is employed is inhibited from vertical displacement thereof at the astern portion and thereby pitching of the vessel body can be reduced to 1/5 to 1/10 of that of the conventional one. Further, vertical displacement or vibration of the cutter head can be reduced to half of that in the conventional system owing to the aforesaid substantial reduction of pitching, although no significant difference is found between both the systems with respect to a magnitude of heaving of the vessel body. This is because any moment which is effective in causing pitching of the vessel body can be absorbed by way of variation in tension of the wire 14 by means of which the spud 8 is suspended as well as variation in embedded pressure of the lowermost end part of the spud.

Next, functional properties of the cutter head with respect to displacement or vibration thereof under the influence of roaring waves will be compared below between the case where the conventional vertical type spud is employed and the case where the inclined type spud of the invention is employed for the working vessel.

Figure 13:
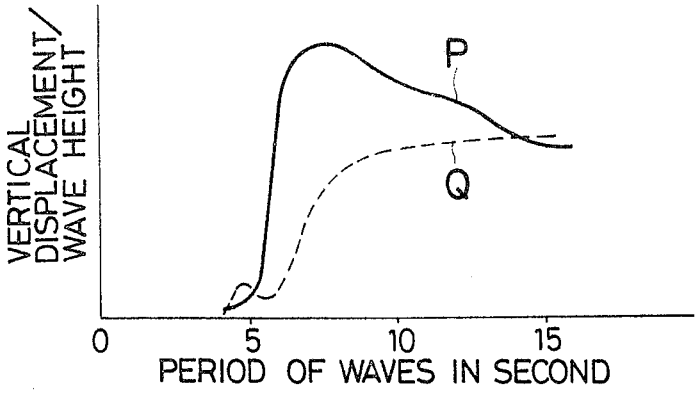
Figure 14:
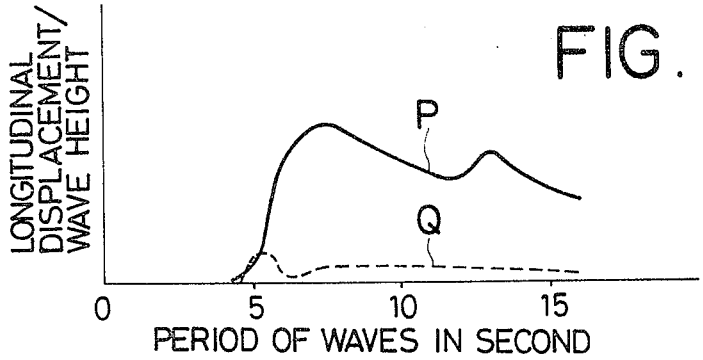
Figure 15:
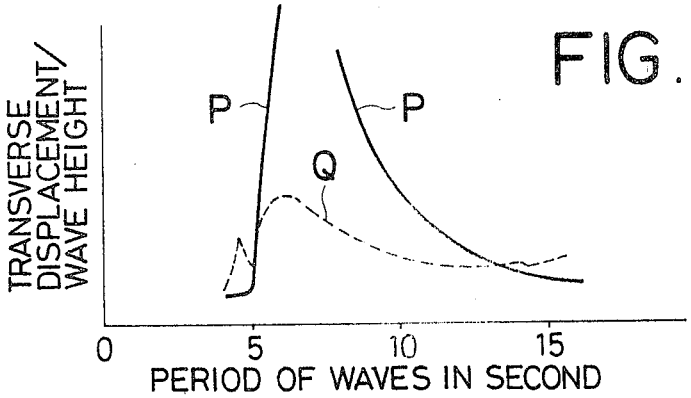

FIGS. 13 to 15 illustrate calculation results of displacement or vibration of the cutter head in the vertical, longitudinal and transverse directions under the influence of waves colliding against the vessel body at a certain inclination angle relative to the longitudinal axis of the latter with respect to both the cases, one of them being such that the inclined type spud of the invention is employed and the other one being such that the conventional vertical type spud is employed for a 6000 PS type pump suction dredger. In the drawings the conventional system is identified with solid lines P, whereas the system of the invention identified with dotted lines Q.

As will be apparent from the drawings, it has been confirmed that the conventional type pump suction dredger carries out dredging operations with much difficulties in a sea area where a so-called swell having a period of 7 to 10 seconds is developed but the dredger to which the invention is applied achieves remarkable improvement at more than two times the conventional critical operational wave height. Further, it has been found that substantial reduction is achieved not only with respect to vibration of fluttering of the cutter head in the vertical and longitudinal directions but also with respect to vibration or fluttering of the same in the transverse direction owing to reduction of yawing and moreover reduction is achieved also with respect to varying force developed in the swing wire.

To sum up, the characterizing features of the dredger in accordance with the invention will be noted below.

(1) It becomes possible to handle the spud as a turning shaft member for the vessel body under any critical climate condition on the sea and moreover it becomes possible to utilize a spud carriage for the purpose of forward displacement of the vessel body.

(2) Reduction is achieved with respect to displacement or vibration of the cutter head in the vertical, longitudinal and transverse directions under the influence of rushing waves and increased accuracy and efficiency of dredging operation and improved operational limit under the influence of roaring waves are assured.

(3) Increased efficiency of a dredging operation is achieved owing to the fact that the center of turning movement of the vessel body in the transverse direction (the embedded or earthed position of the lowermost end part of the spud) is located backward of the astern portion as is the case with the conventional system and thereby a wider width of dredging area is obtained during the dredging operation.

Figure 16:
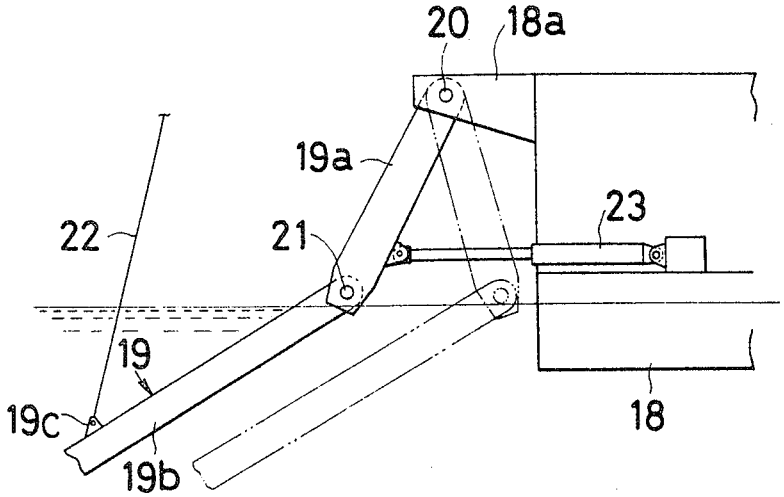
Figure 17:
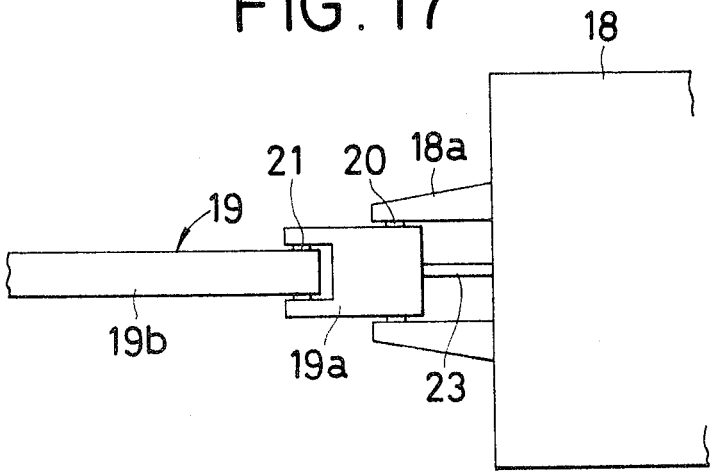

Next, description will be made as to a working vessel in accordance with the second embodiment of the invention with reference to FIGS. 16 and 17. This embodiment consists in that the aforesaid spud carriage is replaced with a new vessel body displacement mechanism which has a high reliability in operation and can be manufactured at an inexpensive cost and said vessel body displacement mechanism is utilized in cooperation with the inclined type spud.

In the drawings reference numeral 18 designates a vessel body of which astern support 18*a* has a spud connecting arm 19*a* pivotally fitted thereto and a spud body 19*b* is pivotally connected to the lower end part of the spud connecting arm 19*a*. Namely, a spud 19 comprises the spud connecting arm 19*a* and the spud body 19*b*. The upper end part of the spud connecting arm 19*a* is pivotally connected to the astern support 18*a* with the aid of a trunnion 20, whereas the spud connecting arm 19*a* is pivotally connected to the spud body 19*b* with the aid of another trunnion 21 which allows the spud body 19*b* to extend at a downward inclination angle toward the bottom of the sea. The spud body 19*b* is hung from a gantry (not shown) fixedly mounted on the vessel body 18 by utilizing a wire 22 of which lower end is anchored at a hook 19*c* fixed onto the spud body 19*b* in the same manner as in the foregoing first embodiment. Reference numeral 23 designates a hydraulic cylinder mounted on the vessel body 18, said hydraulic cylinder 23 including an actuating rod of which foremost end part is pivotally connected to the spud connecting arm 19*a* to swing the latter to and fro.

Since the working vessel in accordance with the second embodiment of the invention is constructed in the above-described manner, the vessel body 18 can be exactly displaced forward by a required distance by swinging the spud connecting arm 19*a* rearward of the vessel body 18 with the aid of the hydraulic cylinder 23, while the lowermost end part of the spud body 19*b* is anchored at the bottom of the sea. Thus, the working vessel in accordance with the second embodiment of the invention has advantageous features that there is no necessity for the conventional spud carriage adapted to move back and forth on the vessel body as is the case with the foregoing first embodiment and therefore a space required for mounting the spud carriage on the vessel board can be spared.

Further, another advantageous feature of the second embodiment is that there is no necessity for arranging guide members and associated reinforcement of the vessel body to a wide extent, said guide members being required for the conventional spud carriage adapted to move back and forth on the vessel body.

Figure 18:
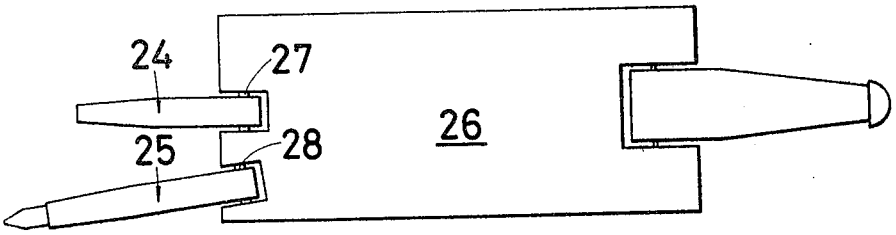
FIG. 18 is a plan view of the working vessel with a gantry removed therefrom and FIG. 19 is a side view of the same.
Figure 19:
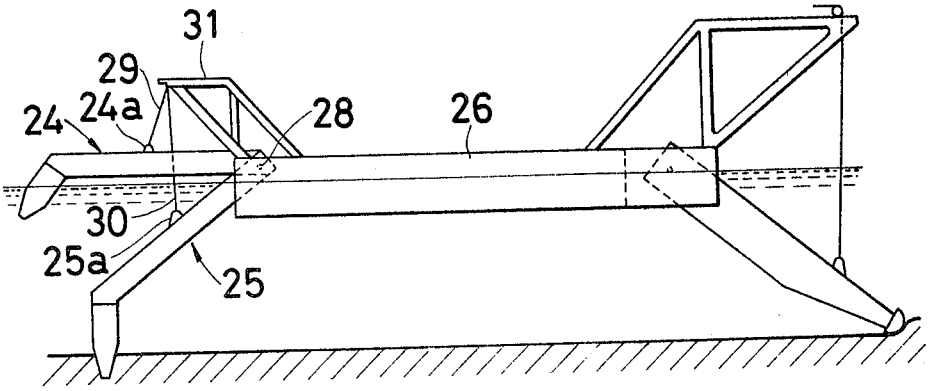

Next, description will be made as to a working vessel in accordance with the third embodiment of the invention with reference to FIGS. 18 and 19. This embodiment consists in that an arm shaft of the spud is pivotally connected directly to the vessel body.

The working vessel in accordance with this embodiment is constructed such that body the spuds 24 and 25 serving as a turning shaft member for the vessel body are operatively connected directly to the vessel body 26 with the aid of trunnions 27 and 28. The auxiliary spud 25 is designed in an inclined type in the same manner as the main spud 24. In FIG. 19 reference numerals 24*a* and 25*a* designate each hook for wires 29 and 30 respectively and reference numeral 31 designates a gantry mounted on the vessel body.

Since the working vessel in accordance with the third embodiment of the invention is constructed in the abovedescribed manner without arrangement of a vessel body displacement mechanism such as spud carriage or the like, forward displacement of the vessel body 26 is carried out in the same manner as the conventional vertical spud system by way of the steps of turning the vessel body by a certain angle, driving the auxiliary spud 25 into the bottom of the sea, lifting up the main spud 24 from the same and then turning the vessel body about the auxiliary spud 25 which serves as a center of turning movement. Other structure and functions are substantially same to those in the foregoing first embodiment.

While the present invention has been described above only with respect to three preferred embodiments, it should be of course understood that it should be not limited only to them but it may be changed or modified without any departure from the spirit and scope of the invention.

What is claimed is:

1. In a working vessel of the type including a vessel body, a working apparatus at one end of the vessel body and a turning shaft member at an opposite end of the vessel body, the improvement comprising: said turning shaft member disposed only at said opposite end and comprising an arm shaft extending toward the bottom of the sea from the vessel body at a downward inclination angle; a lowermost end member connected to a lower end of said arm shaft and adapted to penetrate the bottom of the sea; said arm shaft being pivotally connected to the vessel body by a horizontally extending shaft at an upper end of said arm shaft; a gantry fixedly mounted on the vessel body at said opposite end; a wire extending downward from said gantry and connected to said arm shaft for supporting said arm shaft and thereby tensioning said wire.

2. A working vessel as defined in claim 1, wherein the arm shaft is fitted with a dead weight.

3. A working vessel as defined in claim 1 or 2, wherein the upper end of the arm shaft is pivotally connected to a spud carriage adapted to move back and forth on the vessel body and means for horizontally moving said carriage.

4. A working vessel according to claim 3, including a vertical spud mounted for vertical displacement to said opposite end of said vessel body.

5. A working vessel as defined in claim 1 or 2, further including a spud connecting arm having one end pivotally connected to said arm shaft by way of a horizontally extending shaft and another end pivotally connected to the vessel body by way of a horizontally extending shaft, a driving mechanism fixedly mounted on the vessel body and connected to said spud connecting arm so as to swing said spud connecting arm back and forth in the longitudinal direction with the aid of an actuating rod connected to said spud connecting arm.

6. A working vessel according to claim 5, wherein said actuating rod is connected to a cylinder for moving said actuating rod, a support connected to said vessel body at said opposite end of said vessel body, said spud connecting arm extending below and pivoted to said support.

7. A working vessel as defined in claim 1 or 2, wherein the arm shaft serving as a turning shaft member comprises a main spud shaft and including an auxiliary spud shaft pivotally connected directly to the vessel body by way of a horizontally extending shaft at said opposite end of said vessel body, and a second gantry connected to said vessel body with a wire extending from said gantry and extending to said auxiliary spud shaft for supporting said auxiliary spud shaft.

8. A working vessel according to claim 7, wherein said arm shaft extends parallel to a longitudinal direction of said vessel body, said auxiliary spud shaft extending at an angle to said longitudinal direction and to one side of said arm shaft.

* * * * *